US007704120B2

(12) United States Patent
Chen et al.

(10) Patent No.: US 7,704,120 B2
(45) **Date of Patent: *Apr. 27, 2010**

(54) POSTERIOR-FORM ENHANCEMENT DEVICE

(76) Inventors: David E. Chen, 20912 Granite Wells Rd., Walnut, CA (US) 91789; Jasper Chang, 3383 Pomona Blvd., Pomona, CA (US) 91768

( * ) Notice: Subject to any disclaimer, the term of this patent is extended or adjusted under 35 U.S.C. 154(b) by 9 days.

This patent is subject to a terminal disclaimer.

(21) Appl. No.: 11/797,642

(22) Filed: May 4, 2007

(65) Prior Publication Data

US 2008/0271225 A1 Nov. 6, 2008

(51) Int. Cl.
*A42B 9/00* (2006.01)
*A41C 1/00* (2006.01)

(52) U.S. Cl. ..... 450/99; 2/466

(58) Field of Classification Search ..... 450/94, 450/98, 99; 2/466, 267, 268, 400, 403, 406, 2/228, 227, 238, 69

See application file for complete search history.

(56) References Cited

U.S. PATENT DOCUMENTS 2,332,141 A * 10/1943 Greene ..... 450/98
2,807,806 A * 10/1957 Watkins ..... 4/692
2,928,397 A * 3/1960 Pucci ..... 450/99
3,131,698 A * 5/1964 Morano ..... 450/99
3,295,530 A * 1/1967 Mayer et al. ..... 450/98
4,969,216 A * 11/1990 Guelli ..... 2/400
5,103,505 A * 4/1992 Llorens ..... 2/400
5,649,328 A * 7/1997 Martin ..... 2/238
6,182,297 B1 * 2/2001 Duren et al. ..... 2/228
6,874,168 B1 * 4/2005 Kuhuski ..... 2/227
7,089,601 B2 * 8/2006 Chen ..... 2/400

* cited by examiner

*Primary Examiner*—Gloria Hale
(74) *Attorney, Agent, or Firm*—Muncy, Geissler, Olds & Lowe, PLLC

(57) ABSTRACT

The posterior-form enhancement device includes a garment and two posterior-form pads. Each posterior-form pad is formed by attaching one first posterior-form piece to one second posterior-form piece. The garment is used for covering the lower body part of a person, and in its rear side has two pockets adjacent to the posteriors of wearers for placing the posterior-form pads respectively. Each first posterior-form piece includes a bag for encasing a volume of gel. The second posterior-form pieces are respectively adjacent to the first posterior-form pieces in the pockets, wherein the first posterior-form piece is near an external surface away from wearers' posteriors of while the second posterior-form piece is near an internal surface adjacent to wearers' posteriors. The shape and size of the pockets are determined by the shape and size of the posterior-form pad. The posterior-form pads can be put into or taken out of the pockets.

30 Claims, 10 Drawing Sheets

POSTERIOR-FORM ENHANCEMENT DEVICE

FIELD OF THE INVENTION

The present invention is related to a device for improving the volume and shape of a wearer's posterior, and especially to a posterior-form pad with a garment, such as panties, or a skirt, which is capable of increasing the volume and improving the shape of the wearer's posterior.

BACKGROUND OF THE INVENTION

Generally, most men or women may not obtain the desired body shape of the standard shape, and they also pay great attention to these points. If they are subjected to have a bad shape when they are getting old or sick, they will be eager to obtain the desired shape by every possible ways.

Faces, breasts, chest, posterior, thighs or any other body part can be the targets that people are eager to improve to obtain a desired figure. Among these, it is not easy to enlarge or change the shape of posterior only through exercise or diet. Other methods, such as surgical operations, use of shaping girdles or pants, or use of inserting foam material into garment, can only obtain a limited effect. The above methods have respective defects. For example, the defects of surgical operations include the risk of failure, a long-term harm caused by defects of surgical operations, the expensive charges, and the discomfort of using shaping girdles or pants.

In view of these, the inventor of the present invention provides a posterior-form enhancement device to overcome the above defects.

SUMMARY OF THE INVENTION

An object of the present invention is to provide a posterior-form enhancement device, which renders wearers to obtain naturally modifying effect, and by suitable material and structural designing, the wearers will not have a strange feeling on their posteriors.

Another object of the present invention is to provide a posterior-form enhancement device that allows wearers to flexibly select various sizes and shapes of the posterior-form pads for changing or improving their shapes of the posteriors to desired ones.

Another object of the present invention is to provide a posterior-form enhancement device, wherein the second posterior-form pieces thereof are made by lightweight material suitable for padding, such as foam material, to reduce the amount of used gel encased within the first posterior-form piece, so that the weight and the manufacturing cost of the posterior-form enhancement device can be reduced.

In order to achieve the above objects, the posterior-form enhancement device of the present invention comprises a garment and a posterior-form pad. Each posterior-form pad is formed by attaching one first posterior-form piece to one second posterior-form piece. The garment is used for covering the lower body part of a person, and in its rear side has one pocket located adjacent to each buttock of the posterior of wearers for placing the posterior-form pads respectively. The first posterior-form pieces encase a volume of gel therein. The second posterior-form pieces are attached respectively to the first posterior-form pieces and filled in the pockets. When the posterior-form pads are respectively placed in the pockets, the first posterior-form piece is near an external surface of the second posterior-form piece away from the skin surface of the posterior of wearers while the second posterior-form piece is near an internal surface adjacent to the posterior of the wearer.

The present invention will be apparent after reading the detailed description of the preferred embodiment thereof in reference to the accompanying drawings.

DETAILED DESCRIPTION OF THE PREFERRED EMBODIMENT

Figure 1A:
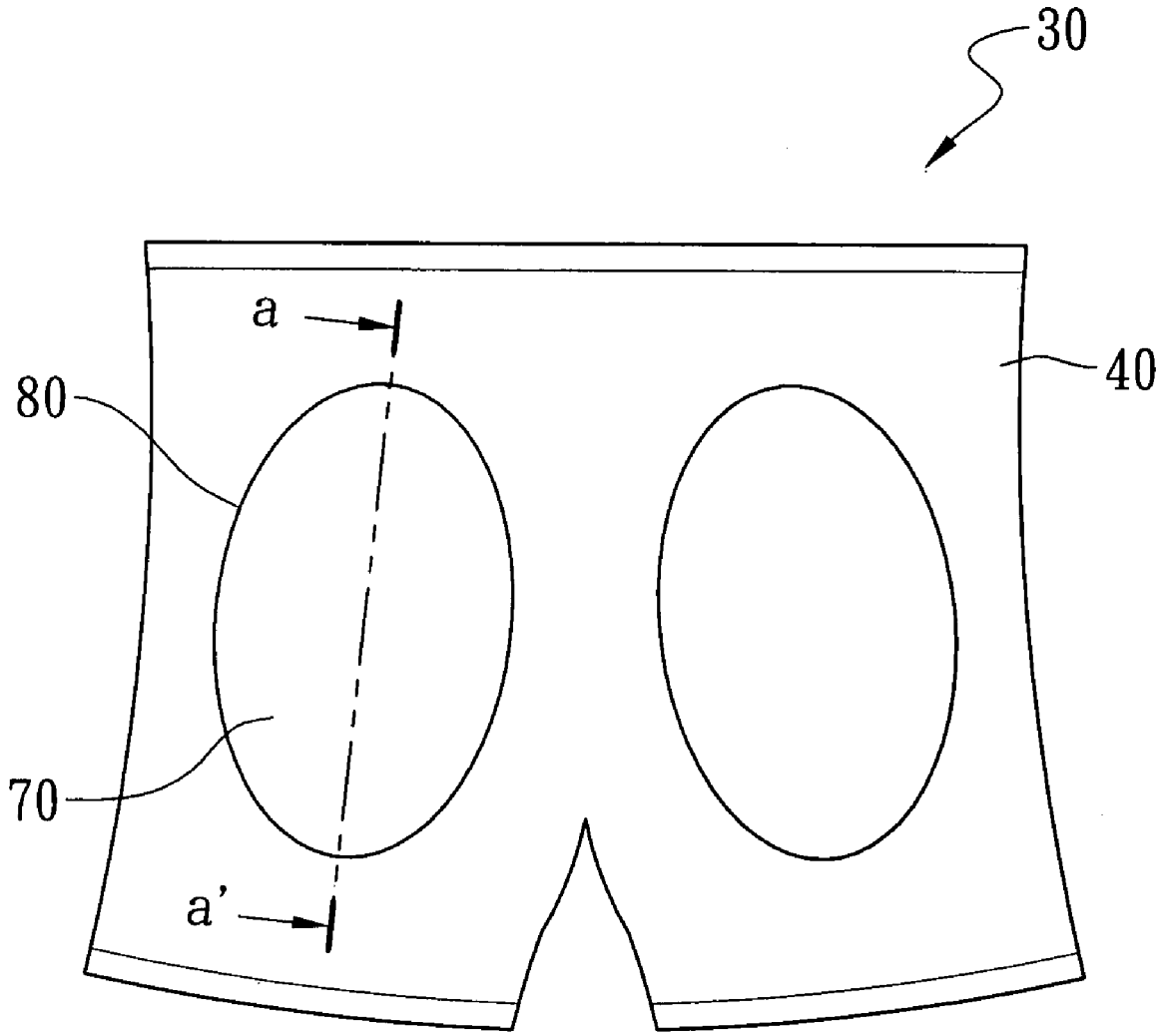
FIG. 1A is a schematic view showing a posterior-form enhancement device of the present invention.

The present invention provides a posterior-form enhancement device 30 comprising a piece of garment 40 and a posterior-form pad 70, which includes a first posterior-form piece 50 and a second posterior-form piece 60. The garment 40 is for covering the lower body part (especially the posterior) of a person, and has a rear side having two pockets 80, one pocket placed respectively adjacent to each buttock of the posterior of the person. Each first posterior-form piece 50 includes a bag 52 for encasing a volume of gel 42 therein. Each second posterior-form piece 60 is attached to each first posterior-form piece 50 and filled in the pocket 80. When each posterior-form pad 70 is placed into one pocket 80, the first posterior-form piece 50 is near an external surface 46 away from the skin surface of the posterior of wearers while the second posterior-form piece 60 is near an internal surface 44 adjacent to the posteriors of wearers.

Figure 1B:
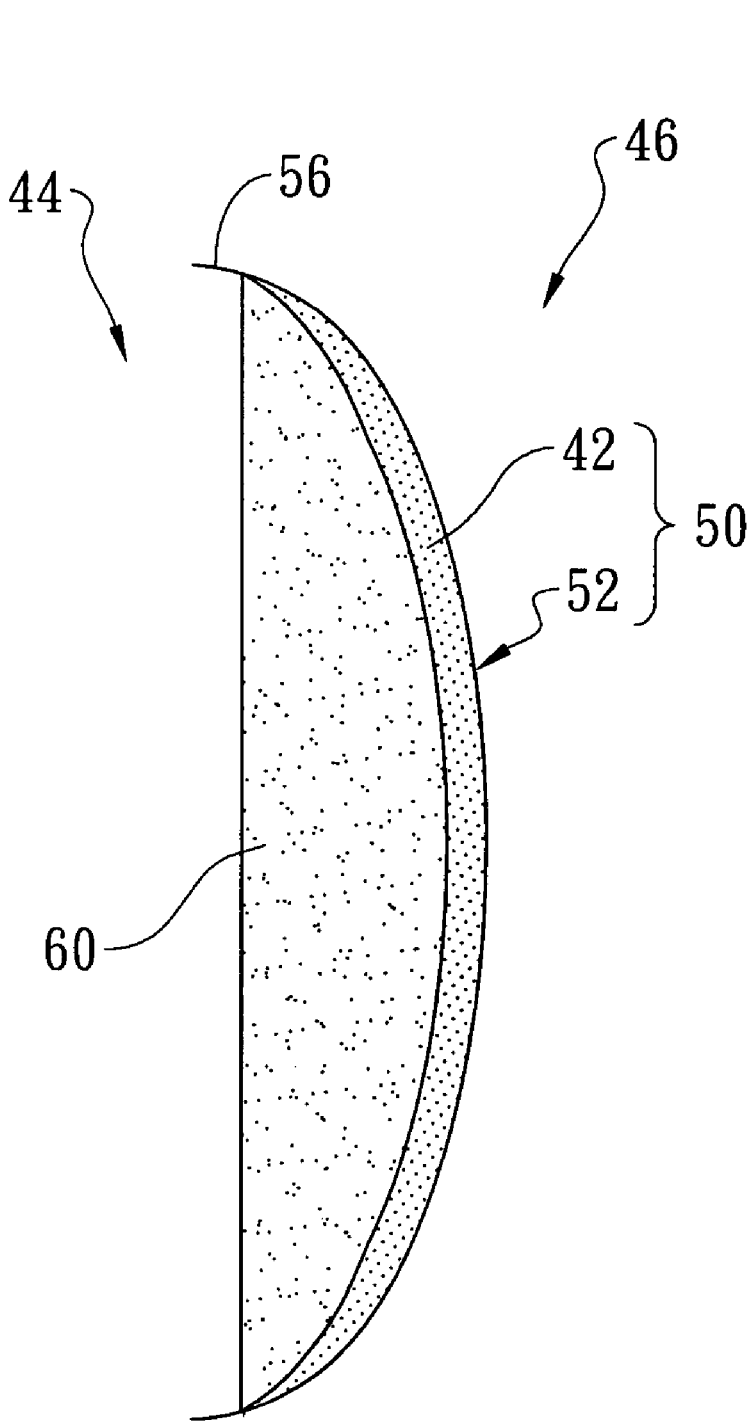
FIG. 1B is a sectional schematic view showing a first posterior-form piece and a second posterior-form piece of the present invention.
Figure 5:
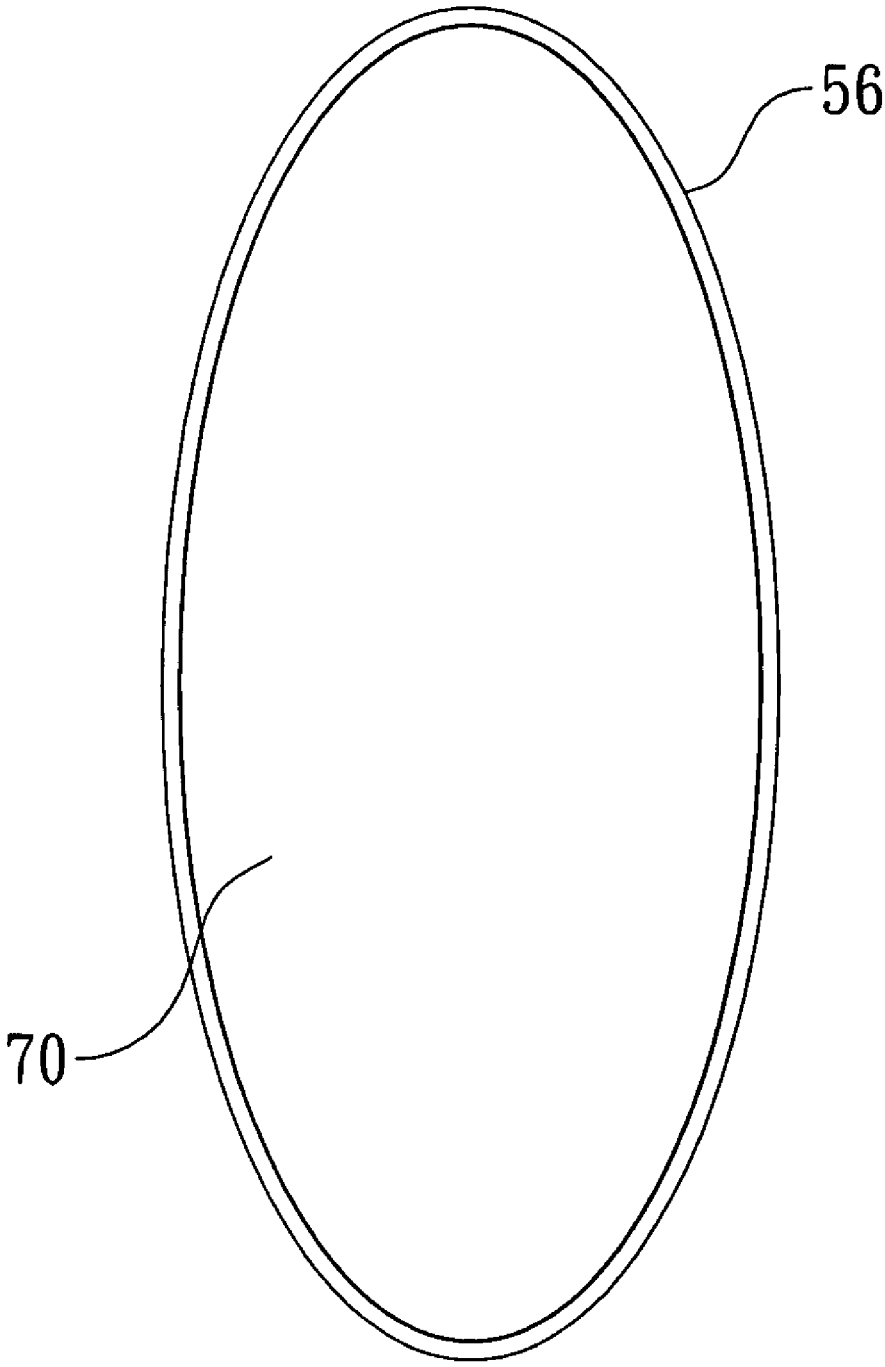
FIG. 5 is a schematic view showing the front side of the pad in FIG. 1.

As shown in FIGS. 1A, 1B, and 5, a posterior-form enhancement device 30 of the present invention comprises a piece of garment 40 and two posterior-form pads 70, each of which includes a first posterior-form piece 50 and a second posterior-form piece 60. In this embodiment, the two pads 70 are all oval shape. The pad 70 has an external surface 46 and an internal surface 44. The garment 40 is like pants or a skirt and has a rear side with two pockets 80 placed respectively adjacent to the posterior of a wearer for covering the lower body part of the wearer, especially the posterior. Each pocket 80 has an envelope structure for placing the posterior-form pad 80 and the shape of the pocket 80 is determined by the shape of the posterior-form pad 70. Each pocket 80 has an opening (not shown) for putting into or taking out the posterior-form pad 70.

Besides, each first posterior-form piece 50 includes a bag 52 and a peripheral extension part 56, where the bag 52 is made by at least a sheet to encase a predetermined volume of gel 42. The external surface of the bag 52 encased with the gel 42 covers 50% to 100% of the external surface 46 area of the posterior-form pad 70. In this embodiment, the external surface of the bag 52 encased with the gel 42 covers all (100%) of the external surface 46 area of the posterior-form pad 70.

The peripheral extension part 56 is made by thin film of thermoplastic material and has a certain width, which is preferably between the ranges of 2-10 mm. By means of the peripheral extension part 56, the height difference between users' skin and the peripheries of the pad 70 can be reduced. In other words, the peripheries of the pad 70 can be smoothly continuous to the skin of users so that it will not cause strange feeling as a result of the height difference between the peripheries of the pad 70 and users' skin.

The gel 42 is elastic gel and is most preferably silicone gel. The sheet can be made of foam material, plastic, rubber, fabric, non-woven fabric, polyurethane, or a kind of mixed material formed from the above materials. In the most preferred embodiment, the sheet is made of thin film of thermoplastic material.

In addition, the second posterior-form pieces 60 are made of lightweight material suitable for padding, such as foam material. Thereby, the weight of the posterior-form enhancement device of the present invention can be reduced, while the contour of the posterior can maintained.

Moreover, to encase the gel in the bag 52 made by at least a sheet, there are two ways can be adopted. First, at least two sheets made by the thermoplastic material can be heated and sealed along the peripheral edge to form a space for partly or entirely encasing the gel 42 there-between. Alternatively, the space can be formed by means of folding and sealing a single sheet. The sheets or a single folding sheet healed or sealed of the part of the first posterior-form piece 50 without gel 42 are attached with each other.

Furthermore, as shown in FIG. 1B, the longitudinal sectional thickness of the posterior-form pad 70 gradually increases from the top thereof downwards, largest at the middle, and decreases gradually from the middle toward the bottom of the posterior-form pad 70.

Figure 1C:
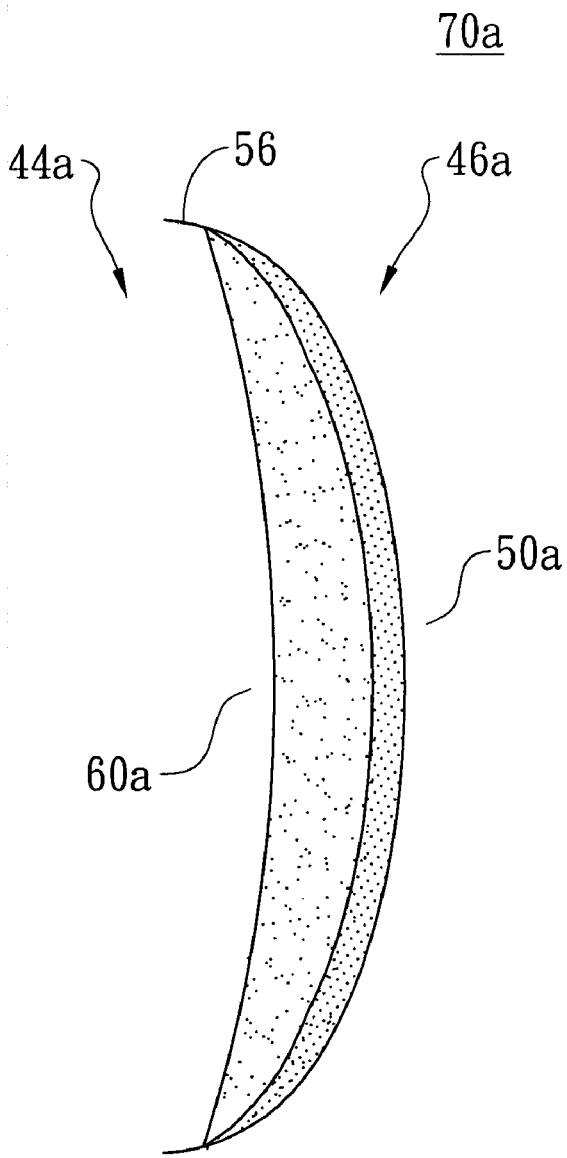
FIG. 1C is a sectional schematic view showing another embodiment of the present invention.

FIG. 1C shows another shape of the posterior-form pad 70*a*, which has an external surface 46 and an internal surface 44, and the internal surface 44*b* is a curved one for more closely fitting the posteriors of users. In this embodiment, the external surface of the bag 52 encased with the gel 42 covers 100% of the external surface 46*a* area of the posterior-form pad 70*a*.

Figure 1D:
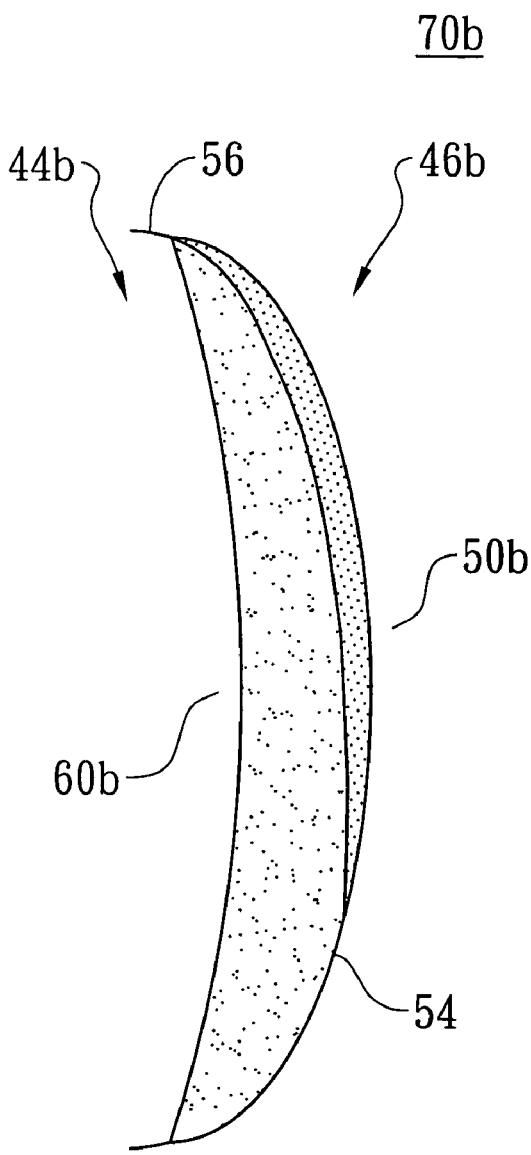
FIG. 1D is a sectional schematic view showing another embodiment of the present invention.

FIG. 1D shows another shape of the posterior-form pad 70*b*, which has an external surface 46 and an internal surface 44, and the internal surface 44*b* is a curved one for more closely fitting the posteriors of users. In this embodiment, the external surface of the bag 52 encased with the gel 42 covers 75% of the external surface 46*b* area of the posterior-form pad 70*b*. Besides, in this embodiment, the first posterior-form piece 60*b* further includes a downward extension part 54 extending substantially parallel to the skin surface of the wearer for attaching the first posterior-form piece 60*b* to the second posterior-form piece 50*b*. The downward extension part 54 is made by thin film of thermoplastic material.

Figure 2:
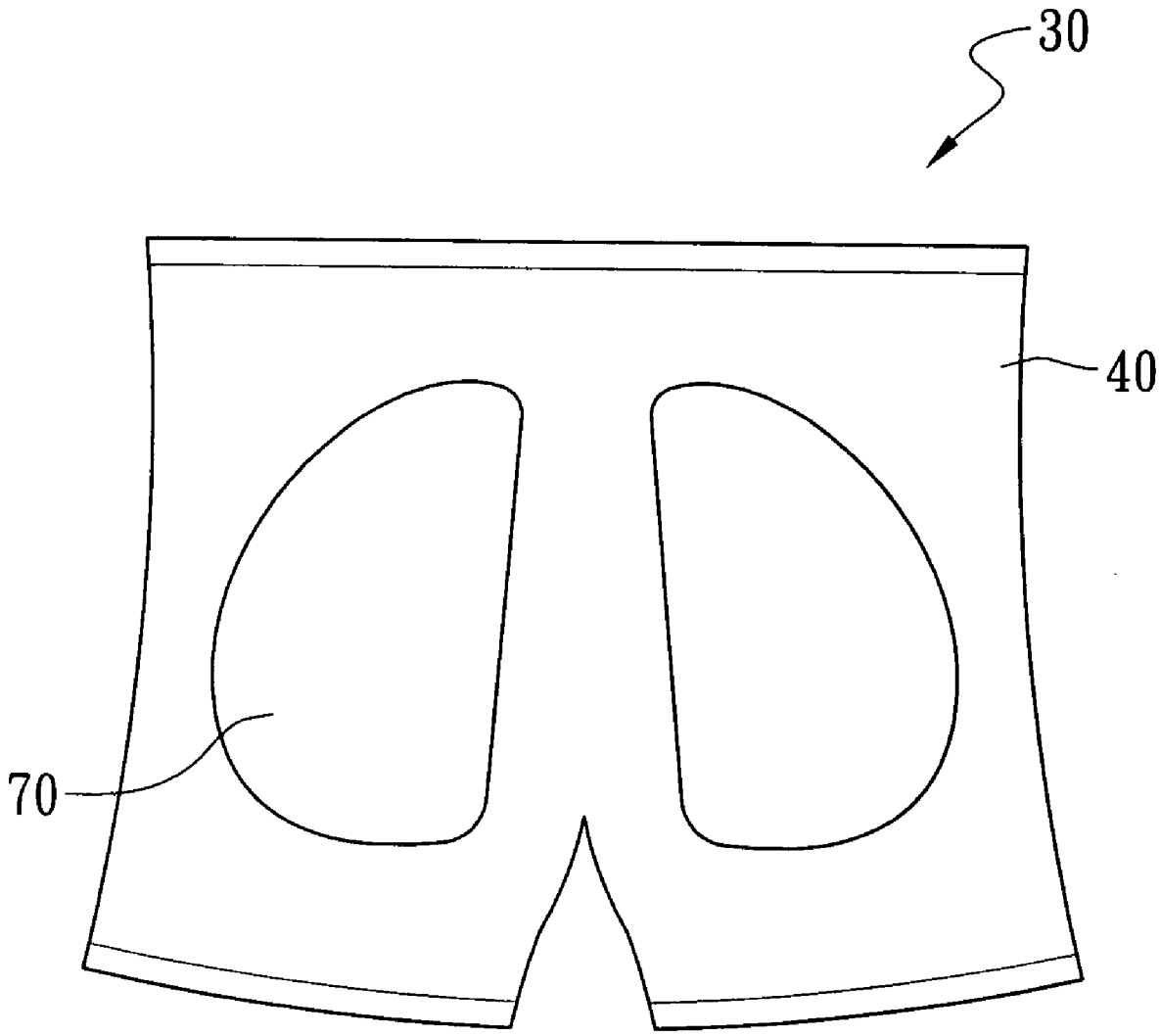
FIG. 2 is a schematic view showing another embodiment of the present invention.

FIG. 2 shows another embodiment of the present invention, where the two pads 70 are each of symmetrical shapes or complementary shapes.

Figure 3A:
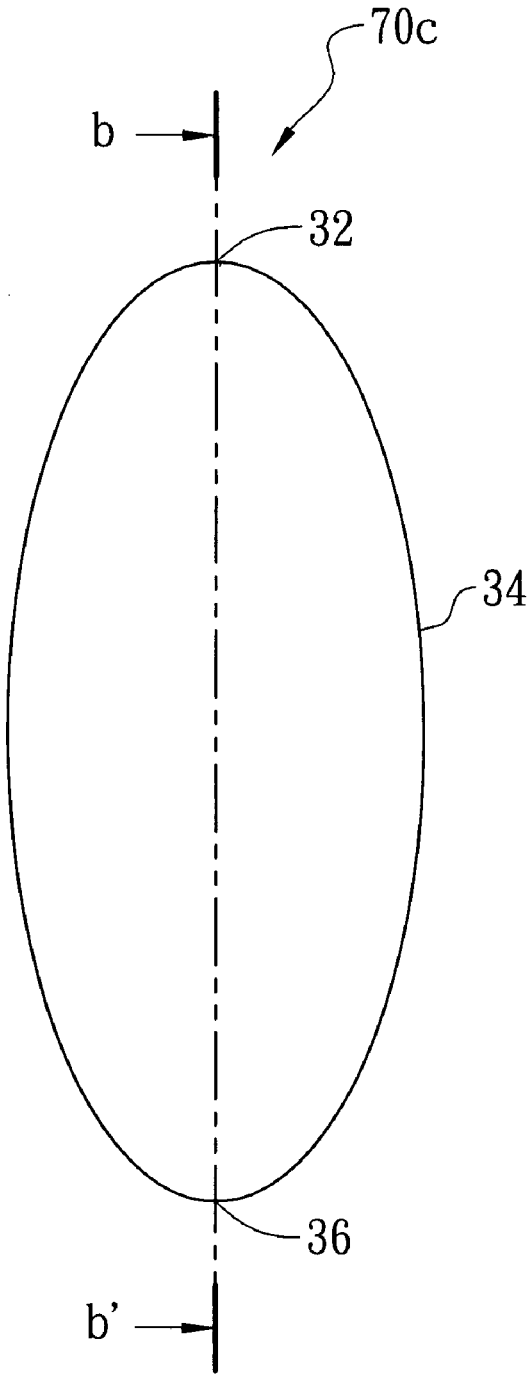
FIG. 3A is a schematic view showing a preferred embodiment of a posterior-form pad of the present invention.
Figure 3B:
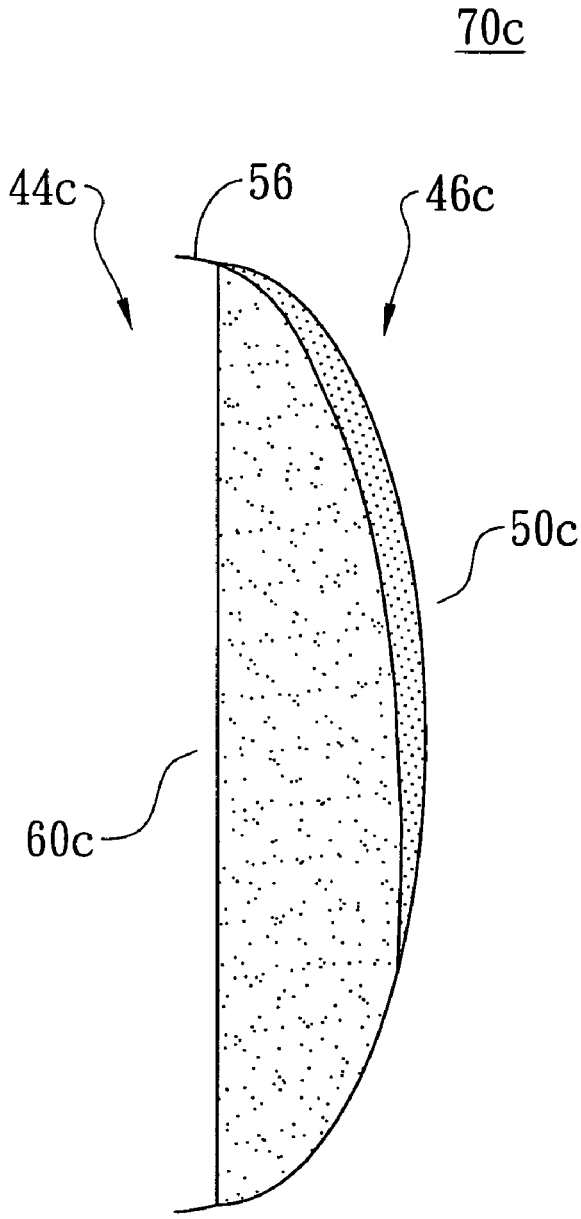
FIG. 3B is a sectional schematic view taken along the line B B' of FIG. 4A to further show the preferred embodiment of the posterior-form pad of the present invention.

The FIGS. 3A and 3B show another embodiment of the present invention. The posterior-form pad 70*c* has a top portion 32, a bottom portion 36, and a lateral portion 34 extending from the top portion 32 to the bottom portion 36 to form an oval shape. This does not, however, limit the shape or size of the first posterior-form piece 50*c*, and only to present a preferred embodiment.

FIG. 3B shows a sectional view of a posterior-form pad 70*c*, having an internal surface 44*c* and an external surface 46*c*. The first posterior-form pieces 50*c* encases a predetermined volume of gel 42 therein. The external surface of the bag 52 encased with the gel 42 covers 50% to 100% of the external surface area of the posterior-form pad 70*c*. In this embodiment, the external surface of the bag 52 encased with the gel 42 covers 75% of the external surface 46*c* area of the posterior-form pad 70*c*.

Figure 3C:
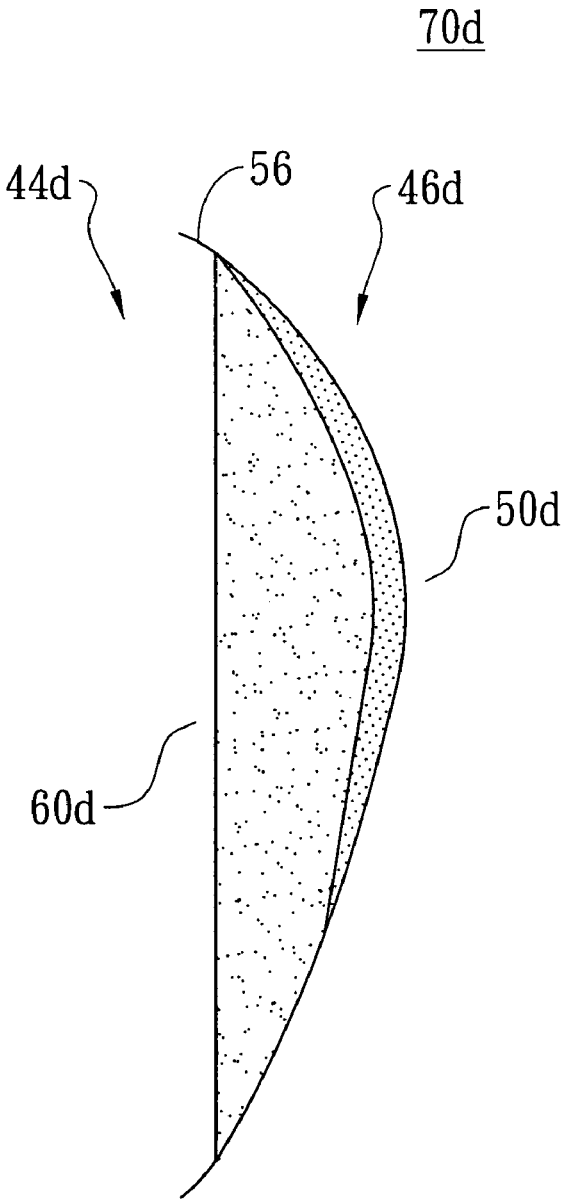
FIG. 3C is a sectional schematic view showing another preferred embodiment of the posterior-form pad of the present invention.

FIG. 3C shows a sectional view of a posterior-form pad 70*d*, where the shape of a posterior-form pad 70*d* can be suitable for a user having specific-shaped posterior, such as sagging posterior. In this embodiment, each posterior-form pad 70*d* includes a first posterior-form piece 50*d* near an external surface 46*d* away from the posteriors of wearers and a second posterior-form piece 60*d* near an internal surface 44*d* adjacent to the posteriors of wearers. The external surface of the bag 52 encased with the gel 42 covers 75% of the external surface area of the posterior-form pad 70*d*. The radian of the external surface 46*d* can be a part of a circle with a suitable radius of curvature. As to the top portion 32 and to the bottom portion 36 of the posterior-form pad 70*d*, the thickness of the first posterior-form piece 50*d* in the sectional view is not symmetrical. The thickness gradually increases from the top portion 32 downwards, largest at the middle from the top portion 32 to the bottom portion 36, and reduces gradually thereafter toward the bottom portion 36. In this mode, the upper part of the posterior-form pad 70*d* gets richer character that can complement the sagging shapes of the upper posterior.

Figure 3D:
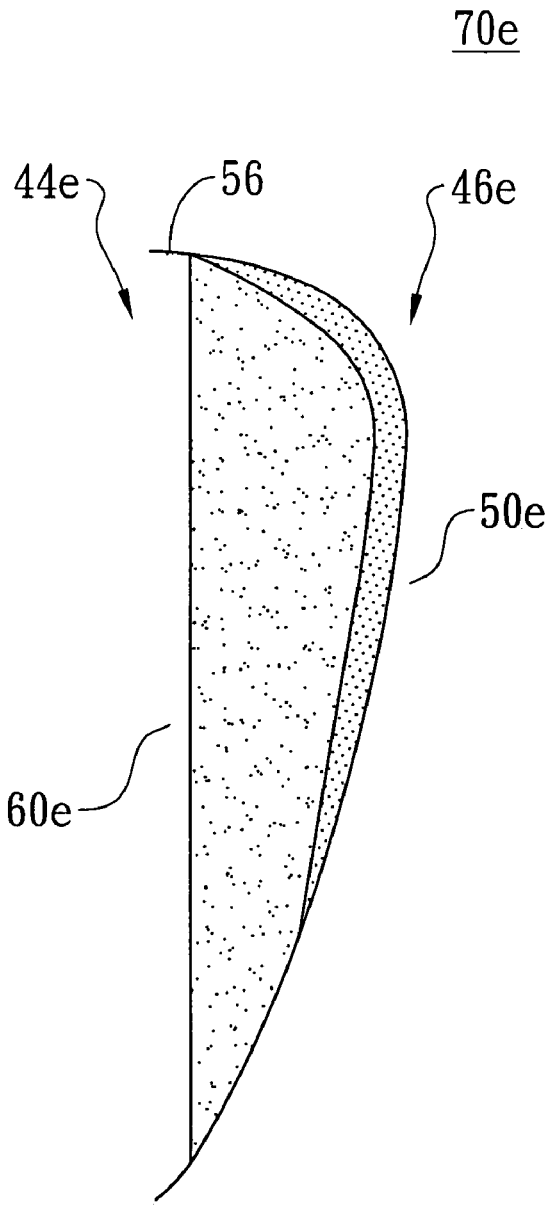
FIG. 3D is a sectional schematic view showing the another preferred embodiment of the posterior-form pad of the present invention.

FIG. 3D shows another sectional view of a posterior-form pad 70*e*, where the shape of a posterior-form pad 70*e* is another preferred embodiment for modifying the sagging posterior shapes of a user. In this embodiment, each posterior-form pad 70*e* includes a first posterior-form piece 50*e* and a second posterior-form piece 60*e*. The posterior-form pad 70*e* includes an internal surface 44*e* and an external surface 46*e* respectively having a radian being arciform or being a part of a circle with a suitable radius of curvature. When the radius of the external surface 46*e* of the circle with the radius of curvature stated is smaller than that of the internal surface 44*e*, a fuller appearance can be obtained. By this design, the upper part of the posterior-form pad 70*e* has a thicker profile than that of the middle part of the posterior-form pad 70*e*, so that a wearer having sagging posterior can have a more graceful posterior shape when wearing on the posterior-form pad 70*e*. In this embodiment, the external surface of the bag 52 encased with the gel 42 covers 75% of the external surface 46*e* area of the posterior-form pad 70*e*.

Figure 4:
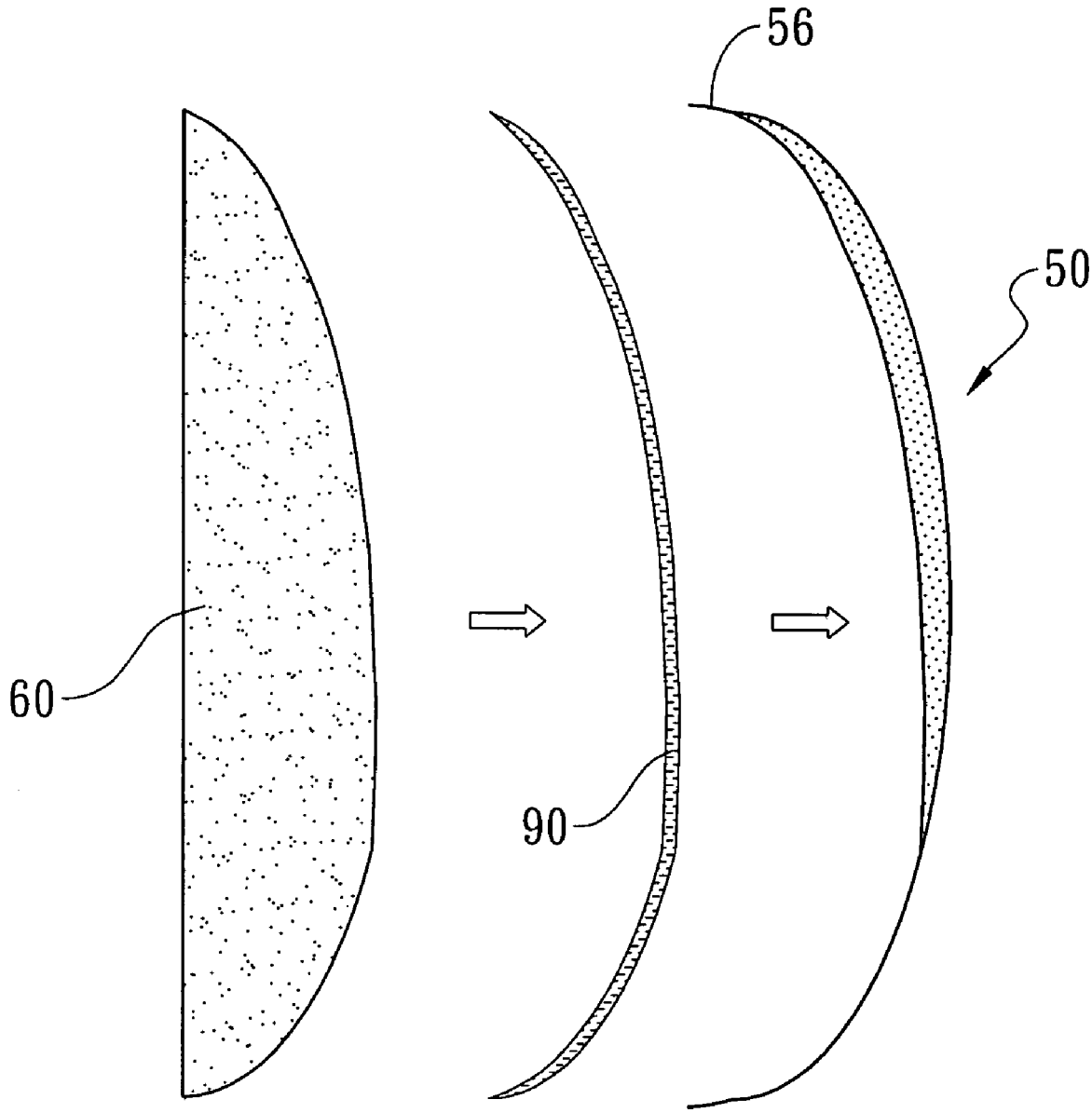
FIG. 4 is a sectional schematic view showing the first posterior-form piece and the second posterior-form piece separable from each other of the present invention.

Furthermore, in this embodiment as shown in FIG. 4, each second posterior-form piece 60 is attached to each first posterior-form piece 50 by using adhesives 90. In additional to the use of adhesives, any other suitable means, such as VEL- CRO™, can be used for attaching each first posterior-form piece 50 to each second posterior-form piece 60.

Figure 6A:
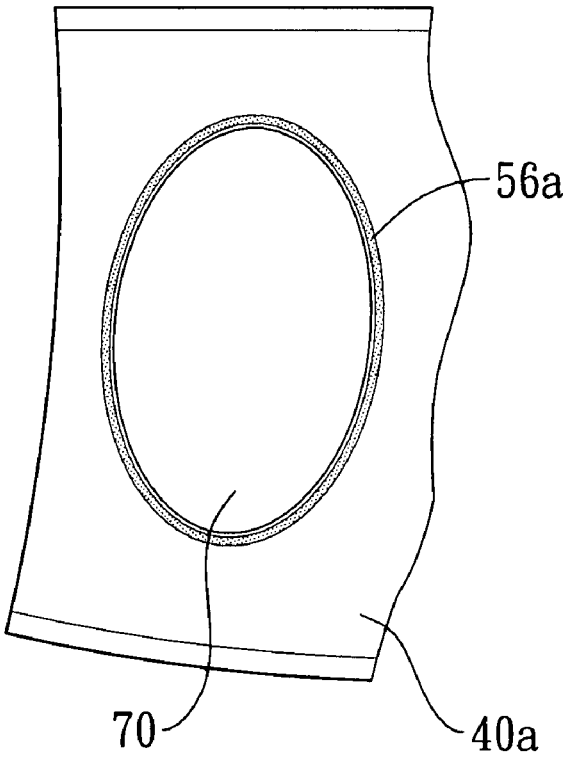
FIG. 6A is a partial schematic view showing another embodiment of the present invention.
Figure 6B:
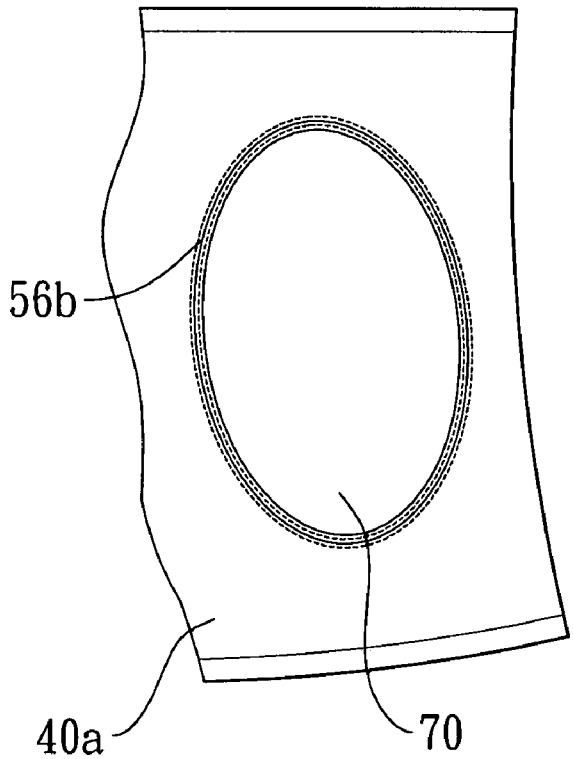
FIG. 6B is a partial schematic view showing another embodiment of the present invention.

FIGS. 6A and 6B show another embodiment according to the present invention. For the purpose of describing this embodiment conveniently, we will assign the same structure with the same number used in the first embodiment. Besides, the same description mentioned above is omitted here. In this embodiment, the posterior-form enhancement device comprises a garment 40*a* and two posterior-form pads 70 for improving the shape of the wearer's posterior. The garment 40*a* is used for covering a lower body part of a person and the two pads 70 are respectively attached to the inner surface of the garment 40*a* adjacent to posterior of a wearer. The two pads can be of identical, symmetrical, or complementary shapes.

As mentioned above, each posterior-form pad 70 has a peripheral extension part 56*a*, 56*b*. As shown in FIG. 6A, the posterior-form pad is weld to the inner surface of the garment 40*a* adjacent to posterior of a wearer via the peripheral extension part 56*a*. Besides, as shown in FIG. 6B, the posterior-form pad can also be sewed to the inner surface of the garment 40*a* via the peripheral extension part 56*b*.

Figure 7:
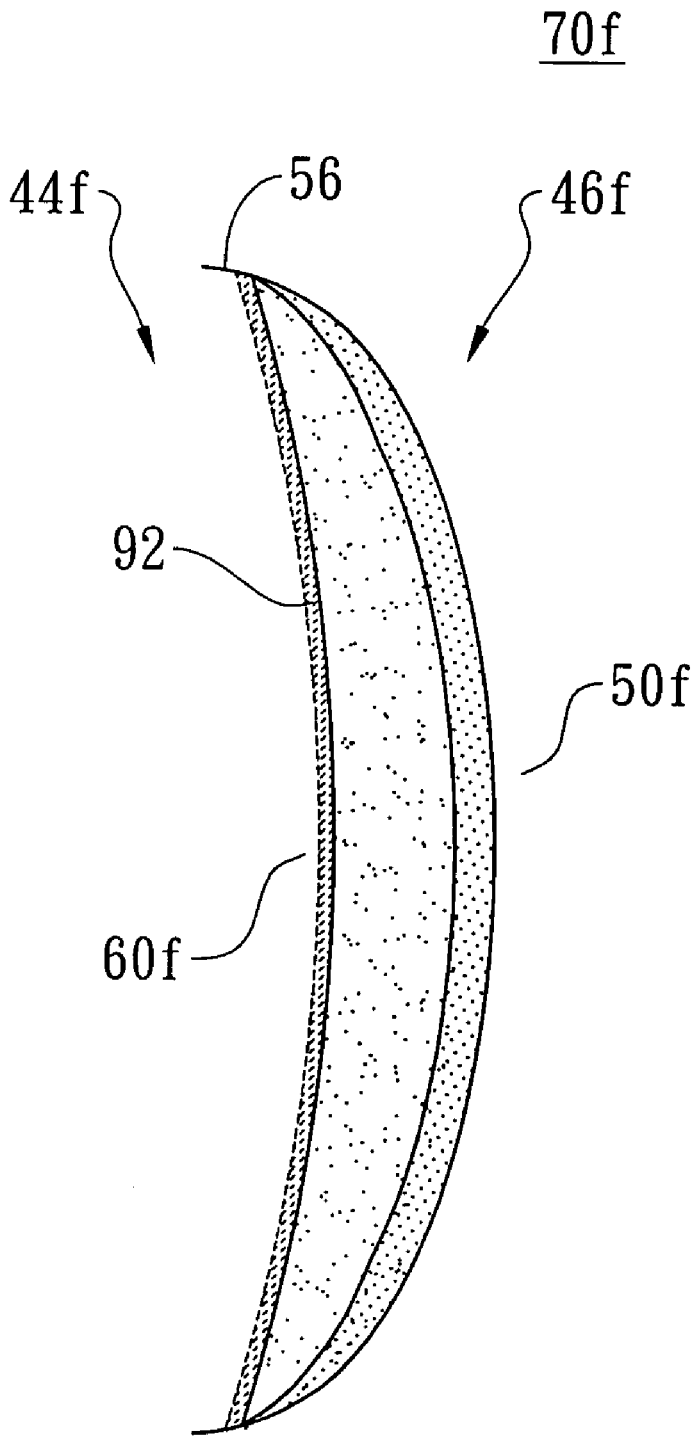
FIG. 7 is a sectional schematic view showing another embodiment of the present invention.

Moreover, as shown in FIG. 7, the posterior-form pad 70*f* can be directly attached to posterior of a wearer by means of a pressure sensitive adhesive layer 92. In this embodiment, the pressure sensitive adhesive layer 92 is provided on an inner surface 44*f* of a second posterior-form piece 60*f* via a thin film adhesive. Besides, the pressure sensitive adhesive layer 92 also can be applied on the inner surface 44*f* directly.

Consequently, the present invention has the following advantages:

1. The posterior-form enhancement device of the present invention renders wearers to obtain naturally modifying effect, and by suitable material and structural designing, the wearer will not have a strange feeling on his posterior.
2. The posterior-form enhancement device of the present invention allows wearers to flexibly select various sizes and shapes of the posterior-form pads for changing or improving their shapes of the posteriors to desired ones.
3. The second posterior-form pieces of the present invention are made by lightweight material to reduce the used amount of gel, so that the weight and the manufacturing cost of the posterior-form enhancement device can be reduced.

Accordingly, as disclosed above, the present invention can surely achieve the expected objects to provide a posterior-form enhancement device having simple structure, various and practicable modeling, and is new and can be put into practice.

While the invention has been described with reference to certain embodiments, it will be understood by those skilled in the art that various changes may be made and equivalents may be substituted without departing from the scope of the present invention.

What is claimed is:

1. A buttocks posterior-form enhancement device for contouring the buttocks of a human wearer, comprising:

a garment for covering a lower body part of a person having a rear side with two buttocks pockets, each pocket being placed respectively adjacent to each buttock of the posterior of said person; and two posterior-form pads for improving the shape of the wearer's posterior placed within said pockets; each posterior-form pad includes a first posterior-form piece and a second posterior-form piece, wherein said first posterior-form piece includes a bag for encasing a volume of gel therein, and said second posterior-form piece is fitted with each first posterior-form piece; when each posterior-form pad is placed in one pocket, the first posterior-form piece is on an external surface of said second posterior-form piece away from the skin surface of the posterior of the wearer while the second posterior-form piece is near an internal surface adjacent to the posterior buttock skin surface of the wearer.

2. The buttocks posterior-form enhancement device as in claim 1, wherein the two pads are both formed to have symmetrical shapes or complementary shapes.

3. The buttocks posterior-form enhancement device as in claim 1, wherein the posterior-form pad has a flat internal surface.

4. The buttocks posterior-form enhancement device as in claim 1, wherein the posterior-form pad has a curved internal surface.

5. The buttocks posterior-form enhancement device as in claim 1, wherein each first posterior-form piece further includes a downward extension part for attaching said first posterior-form piece to said second posterior-form piece.

6. The buttocks posterior-form enhancement device as in claim 5, wherein the bag and the downward extension part are made of a thin film of thermoplastic material.

7. The buttocks posterior-form enhancement device as in claim 1, wherein each posterior-form pad further includes a peripheral extension part.

8. The buttocks posterior-form enhancement device as in claim 7, wherein the peripheral extension part is made of a thin film of thermoplastic material.

9. The buttocks posterior-form enhancement device as in claim 1, wherein each first posterior-form piece is attached to each second posterior-form piece via adhesives.

10. The buttocks posterior-form enhancement device as in claim 1, wherein each pocket has an opening for putting in or taking out said posterior-form pad.

11. The buttocks posterior-form enhancement device as in claim 1, wherein the bag is made of a thin film of thermoplastic material.

12. The buttocks posterior-form enhancement device as in claim 1, wherein said gel is elastic gel.

13. The buttocks posterior-form enhancement device as in claim 12, wherein said elastic gel is silicone gel.

14. The buttocks posterior-form enhancement device as in claim 1, wherein said second posterior-form pieces are made of a foam material.

15. The buttocks posterior-form enhancement device as in claim 1, wherein the external surface of the bag encased with the gel covers 50% to 100% of an area of said external surface of said posterior-form pad.

16. A posterior-form pad for contouring posterior buttocks of a human wearer, comprising:

a first posterior-form piece, which includes a bag for encasing a volume of gel therein, said first posterior form piece having an internal surface; and a second posterior-form piece having an external surface and an internal surface which is attached to said internal surface of said first posterior-form piece, wherein said second posterior form piece has an internal surface adjacent to the posterior of the buttock of the wearer.

17. The buttocks posterior-form enhancement device as in claim 16, wherein a pressure sensitive adhesive layer is further attached to the internal surface of the second posterior-form piece by a thin film adhesive for attaching the pad to the posterior buttock of a wearer.

18. The buttocks posterior-form enhancement device as in claim 16, wherein each posterior-form pad further includes a peripheral extension part.

19. The buttocks posterior-form enhancement device as in claim 18, wherein a garment is further provided and the pad is sewn or welded to the inner surface of said garment adjacent to the skin surface of the posterior buttock of the wearer.

20. The buttocks posterior-form enhancement device as in claim 18, wherein the peripheral extension part is made of a thin film of thermoplastic material.

21. The buttocks posterior-form enhancement device as in claim 16, wherein each first posterior-form piece further includes a downward extension part extending substantially parallel to the skin surface of the wearer for attaching said first posterior-form piece to said second posterior-form piece.

22. The buttocks posterior-form enhancement device as in claim 21, wherein the bag and the downward extension part are made of a thin film of thermoplastic material.

23. The buttocks posterior-form enhancement device as in claim 16, wherein the posterior-form pad has a flat internal surface.

24. The buttocks posterior-form enhancement device as in claim 16, wherein the posterior-form pad has a curved internal surface.

25. The buttocks posterior-form enhancement device as in claim 16, wherein each first posterior-form piece is attached to each second posterior-form piece via adhesives.

26. The buttocks posterior-form enhancement device as in claim 16, wherein the bag is made by thin film of thermoplastic material.

27. The buttocks posterior-form pad as in claim 16, wherein said gel is elastic gel.

28. The buttocks posterior-form pad as in claim 27, wherein said elastic gel is silicone gel.

29. The buttocks posterior-form pad as in claim 16, wherein said second posterior-form pieces are made of a foam material.

30. The buttocks posterior-form enhancement device as in claim 16, wherein the external surface of the bag encased with the gel covers 50% to 100% of an area of said external surface said posterior-form pad.

* * * * *